US007284895B2

(12) United States Patent
Goto

(10) Patent No.: US 7,284,895 B2
(45) Date of Patent: Oct. 23, 2007

(54) POTTED LAMP SOCKET

(75) Inventor: Kazuhiro Goto, Ontario (CA)

(73) Assignee: Tyco Electronics Canada, Ltd., Markham, Ontario (CA)

( * ) Notice: Subject to any disclaimer, the term of this patent is extended or adjusted under 35 U.S.C. 154(b) by 263 days.

(21) Appl. No.: 11/061,806

(22) Filed: Feb. 21, 2005

(65) Prior Publication Data

US 2006/0187682 A1 Aug. 24, 2006

(51) Int. Cl.
*H01R 33/00* (2006.01)

(52) U.S. Cl. ..... 362/645; 362/659; 362/267; 313/318.09; 439/699.2

(58) Field of Classification Search ..... 362/267, 362/519, 549, 645, 657–659; 439/699.2; 313/318.09
See application file for complete search history.

(56) References Cited

U.S. PATENT DOCUMENTS

| | | | | |
|---|---|---|---|---|
| 4,603,278 | A | 7/1986 | Devir et al. | |
| 5,121,304 | A | 6/1992 | Hall et al. | |
| 5,130,911 | A | 7/1992 | Eisner, Sr. | |
| 5,197,187 | A | 3/1993 | Thomas | |
| 5,865,647 | A | 2/1999 | Garber et al. | |
| 5,971,814 | A | 10/1999 | Boyd et al. | |
| 6,083,050 | A | 7/2000 | Hsu | |
| 6,250,970 | B1 | 6/2001 | Key et al. | |
| 6,467,942 | B2 | 10/2002 | Alloway et al. | |
| 7,014,510 | B2 * | 3/2006 | Powers et al. | 439/699.2 |
| 2003/0068929 | A1 | 4/2003 | Powers et al. | |
| 2004/0132336 | A1 | 7/2004 | Powers et al. | |

* cited by examiner

*Primary Examiner*—Stephen F Husar

(57) ABSTRACT

A lamp and socket assembly includes a lamp assembly including a lamp holder having an end panel, and a housing having a lamp side and a wire side. The lamp side includes a lamp receptacle. The lamp holder is received in the lamp receptacle. A channel is formed in the lamp receptacle. The channel includes opposed side walls, and each side wall has an engagement surface. The engagement surfaces engage side edges of the end panel to retain the lamp assembly in the lamp receptacle. A method for sealing the wiring cavity in a lamp socket includes fabricating the lamp socket with a passageway between the wiring cavity and the lamp side of the socket housing, positioning the socket housing on a non-adhering surface with the lamp side facing upward such that the wiring cavity is blocked by the non-adhering surface, introducing a potting compound into the wiring cavity from the lamp side of the socket housing through the passageway, and removing the socket housing from the non-adhering surface after the potting compound has hardened.

18 Claims, 10 Drawing Sheets

POTTED LAMP SOCKET

BACKGROUND OF THE INVENTION

The invention relates generally to a lamp socket, and more specifically to a lamp socket for exterior lighting on a motor vehicle.

Exterior lighting systems on motor vehicles include a variety of lamps that perform functions from illuminating the roadway and the vehicle to providing indications to the drivers of other vehicles or pedestrians. The lamps used for exterior lighting on motor vehicles are typically held in lamp sockets that are, in turn, mounted in lamp housings on the vehicle. Each lamp housing is provided with one or more mounting holes in a back wall or side wall for mounting one or more lamp sockets. The lamp sockets are generally mounted in the mounting holes such that the lamp extends into the interior of the lamp housing and a wire receiving side of the lamp socket is outside the lamp housing.

Typically the mounting holes are sealed with gaskets so that the interior of the lamp housing is protected from moisture; however, the portion of the lamp socket that is outside the lamp housing may be exposed to the elements. As a result, the lamp socket is commonly sealed to prevent the entry of moisture and debris into the lamp socket which could cause premature failure of the lamp socket due to moisture and corrosion. In some sockets, sealing is provided by separate sealing boots that fit over the end of the lamp socket and have holes to accommodate electrical wiring to the lamp socket. In other designs, the wire receiving end of the lamp socket is sealed with a potting compound. One problem associated with potting the lamp socket is that steps must be taken to prevent the potting compound from entering the contact area on the lamp side of the lamp socket and interfering with the operation of the lamp. For example, U.S. Published Patent Application 20030068929 describes a socket wherein a cover plate is formed on the contact terminals to block the entry of sealing material into the contact area of the socket.

A most basic requirement of the many different lamp socket designs in use today, is the requirement that the lamp socket secure the lamp against damage, including damage from vibration that occurs during operation of the vehicle. At least some lamp sockets retain the lamp in a manner that allows for an amount of lateral lamp movement within the socket. Such lateral movement of the lamp within the socket is undesirable in that it adversely affects the interface between the lamp lead wires and the lamp socket contacts and is a common source of failure in the lighting system. In one approach to retaining a wedge base lamp, U.S. Pat. No. 5,197,187 describes a lamp socket wherein the terminal contacts include beams that retain a lamp base in the socket. U.S. Published Patent Application 20040132336 and its parent, Published Application 20030068929 describe lamp sockets that include features that, in conjunction with terminals, align, stabilize, and retain the lamp bulbs in the sockets.

A need remains for a cost effective lamp socket that provides sealing, lamp retention, and lamp stabilization that render the lamp socket suitable for use in the often harsh environment associated with motor vehicle lighting.

BRIEF DESCRIPTION OF THE INVENTION

In one aspect, a lamp and socket assembly is provided. The lamp and socket assembly includes a lamp assembly including a lamp holder having an end panel and a housing having a lamp side and a wire side. The lamp side includes a lamp receptacle. The lamp holder is received in the lamp receptacle. A channel is formed in the lamp receptacle. The channel includes opposed side walls, and each side wall has an engagement surface. The engagement surfaces engage side edges of the end panel to retain the lamp assembly in the lamp receptacle.

Optionally, the lamp and socket assembly further includes a seal mounted on the housing to seal a mounting hole in a lamp housing. The lamp receptacle includes first and second open channels, and each open channel includes an end wall and a pair of opposed side walls. Each open channel receives one of the end panels of the lamp holder. The lamp receptacle also includes a pair of stabilizing towers. Each stabilizing tower defines a passageway therethrough extending from the lamp side to the wire side of the housing.

In another aspect, a lamp socket for holding a lamp mounted in a lamp holder is provided. The said lamp socket includes a housing having a lamp side and a wire side. The lamp side including a lamp receptacle configured to receive the lamp holder. A passageway extends from the lamp side to the wire side. The passageway has a lamp side opening that is elevated from a floor separating the lamp side from the wire side. The passageway is configured to convey a potting material from the lamp side to the wire side to seal the wire side.

In yet another aspect, a method is provided for sealing the wiring cavity in a lamp socket housing, wherein the socket housing includes a wire side and a lamp side with the wiring cavity located in the wire side. The method includes fabricating the lamp socket with a passageway between the wiring cavity and the lamp side of the socket housing, positioning the socket housing on a non-adhering surface with the lamp side facing upward and the wiring cavity facing downward such that the wiring cavity is blocked by the non-adhering surface, introducing a potting compound into the wiring cavity from the lamp side of the socket housing through the passageway, and removing the socket housing from the non-adhering surface after the potting compound has hardened.

DETAILED DESCRIPTION OF THE INVENTION

Figure 1:
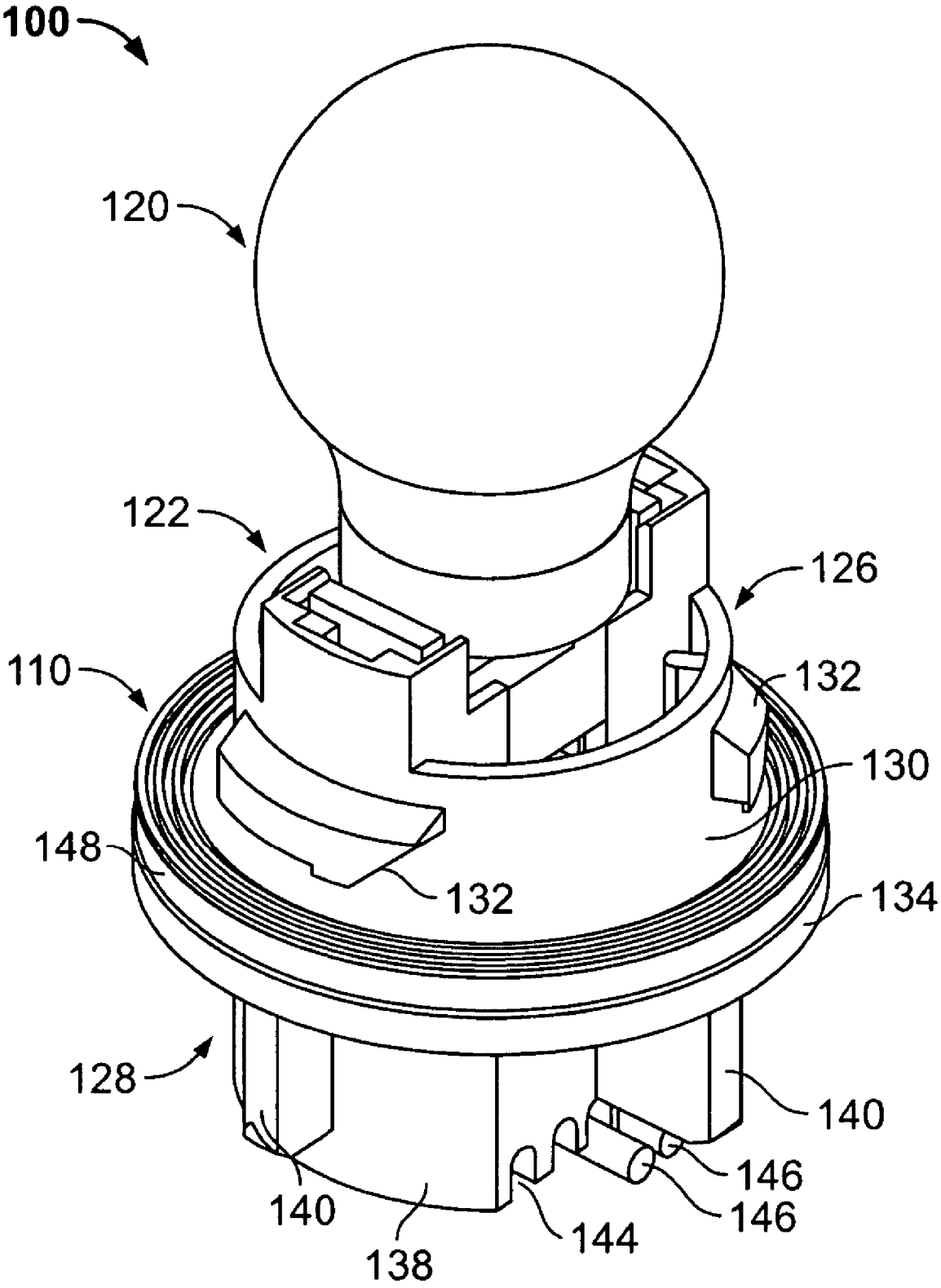
FIG. 1 is a perspective view of a lamp and socket assembly formed in accordance with an exemplary embodiment of the present invention.

FIG. 1 is a perspective view of a lamp and socket assembly 100 formed in accordance with an exemplary embodiment of the present invention. While the lamp and socket 100 will be described with particular reference to a vehicle lighting system, it is to be understood that the benefits herein described are also applicable to other applications in alternative embodiments. The following description is therefore provided for purposes of illustration, rather than limitation, and is but one potential application of the inventive concepts herein.

The lamp and socket assembly 100 includes a lamp socket 110 and a lamp assembly 120 that is mounted in the lamp socket 110. The lamp socket 110 includes a housing 122 that has a lamp side 126 and a wire side 128. The lamp side 126 has an outer shell 130 that has a plurality of lugs 132 formed thereon. A mounting flange 134 separates the lamp side 126 and the wire side 128 of the housing 122. The wire side 128 includes an outer shell 138. A plurality of tabs 140 are formed on the wire side outer shell 138. A plurality of wire guide channels 144 are formed in the wire side outer shell 138 to permit the entry of wires 146 into a wiring cavity 266 (FIG. 5) in the interior of the wire side 128 of the housing 122. A seal 148 is positioned on the mounting flange 134. In an exemplary embodiment, the seal 148 comprises a sealing gasket which may or may not include sealing ribs formed thereon.

Figure 2:
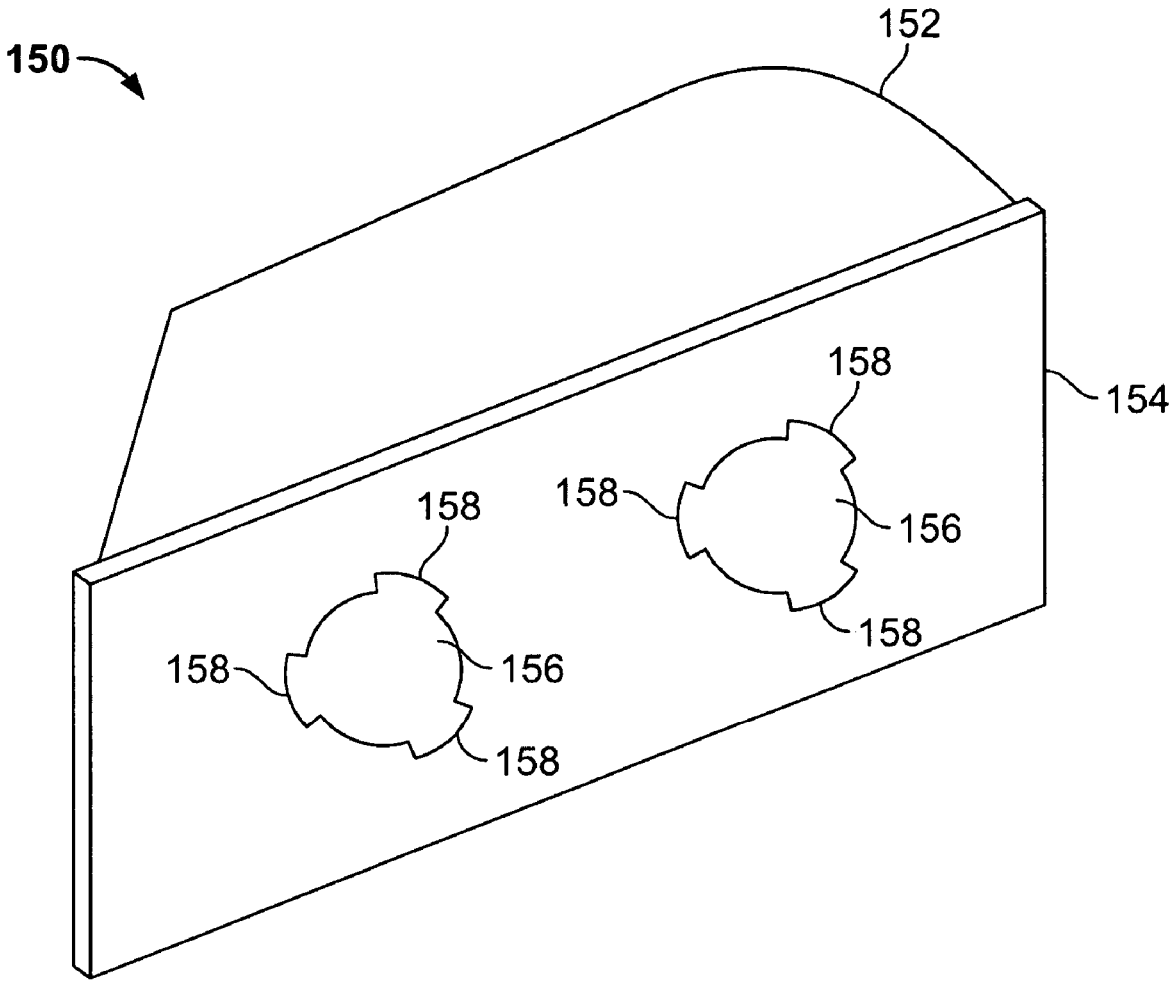
FIG. 2 (Prior Art)
FIG. 2 illustrates a known lamp housing.

FIG. 2 illustrates a known lamp housing 150 as may be used on a motor vehicle in a vehicle lighting system. The lamp and socket assembly 100 may, in one embodiment, may be mounted in the lamp housing 150, for use in the vehicle lighting system. The lamp housing 150 is typically fabricated from a plastic material and has an exterior reflecting cover 152 and a socket mounting plate 154 with mounting holes 156. The reflecting cover 152 and the socket mounting plate 154 cooperate to form a lamp chamber (not shown) in the interior of the reflecting cover 152.

The lamp side 126 of the socket housing 122 is configured to be received into the lamp chamber (not shown) of the lamp housing 150 at an insertion position with the lugs 132 passing through cutouts 158 extending from the mounting holes 156. Rotation of the lamp and socket assembly 100 about one quarter of a turn from the insertion position brings the lugs 132 into engagement with an interior surface (not shown) of the socket mounting plate 154 such that the lugs 132 retain the lamp and socket assembly 100 in the lamp housing 150. In some embodiments, the lugs 132 and the interior surface of the socket mounting plate 154 may include complementary features that cooperate to lock the lamp and socket assembly 100 in place in the lamp housing 150. The tabs 140 are provided to facilitate rotation of the lamp and socket assembly 100. Rotation is typically in a clockwise direction, however in some embodiments, the lugs 132 and the socket mounting plate may be configured for counterclockwise rotation of the lamp and socket assembly 100.

The seal 148 (FIG. 1) is provided to seal the mounting hole 156 to prevent the entry of moisture and debris into the lamp chamber. In one embodiment, the lamp and socket assembly 100 may be a W-2.5 type wedge based lamp and socket assembly.

Figure 3:
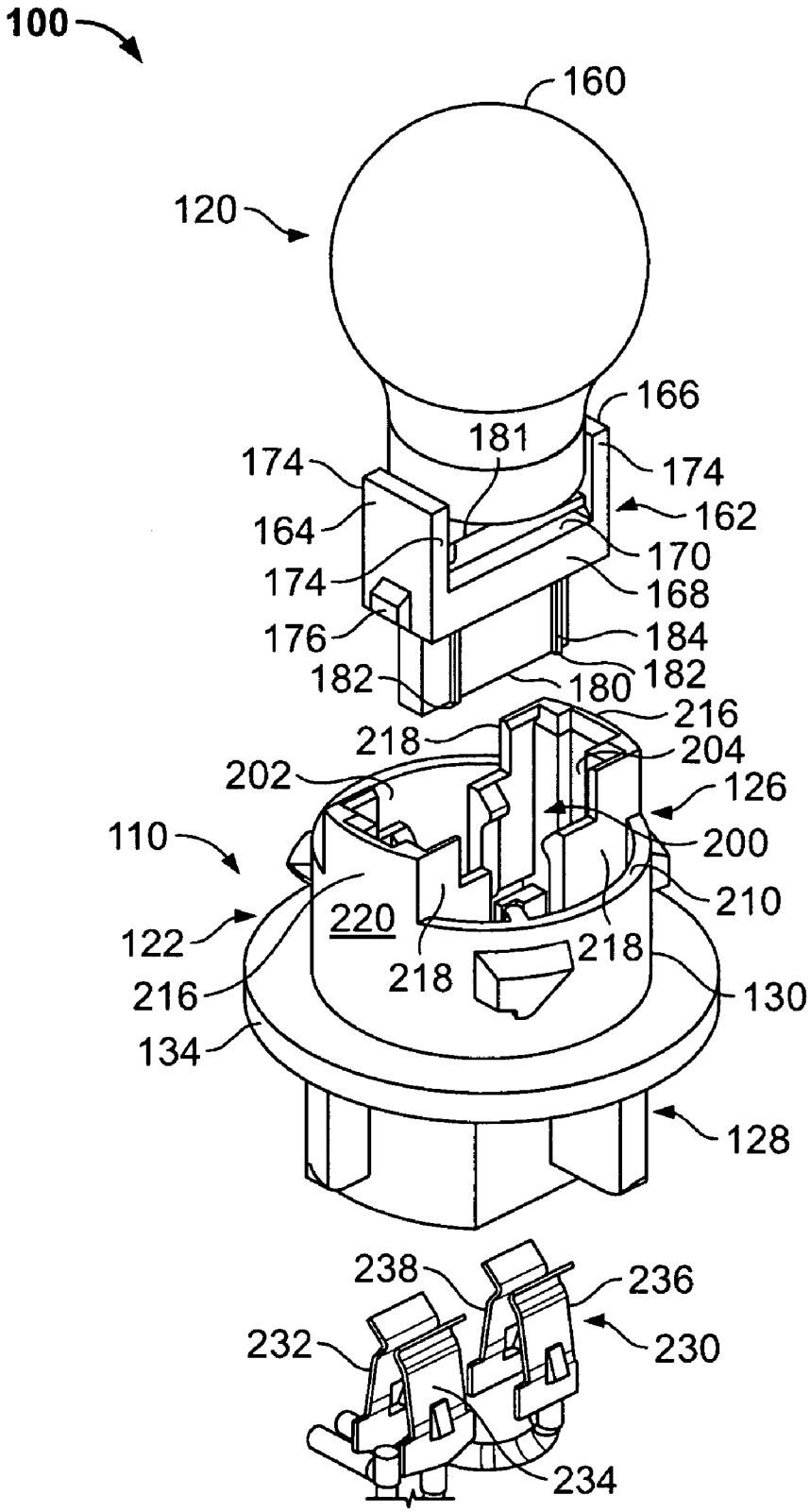
FIG. 3 is an exploded view of the lamp and socket assembly shown in FIG. 1.

FIG. 3 is an exploded view of the lamp and socket assembly 100. The lamp assembly 120 is a known assembly that includes a lamp or bulb 160 that upwardly extends from a lamp holder 162. The lamp holder 162 includes a first end panel 164 and a second end panel 166 that extend from a cross member 168. The lamp 160 is positioned between the end panels 164 and 166 and rests on the cross member 168. The cross member 168 includes beveled retention ledges 170 that extend on opposite sides of the cross member 168 between the end panels 164 and 166. The end panels 164 and 166 each include side edges 174 and a tab 176 centrally positioned between the side edges 174. The lamp 160 includes an integrally formed extension 180 that extends downwardly through a slot 181 formed in the cross member 168. Electrical contacts 182 are located in grooves 184 in the lamp extension 180. The contacts 182 are electrically connected to one or more filaments (not shown) within the lamp 160.

The housing 122 of the lamp socket 110 is fabricated from a dielectric material and in an exemplary embodiment is a unitary structure that comprises the lamp side 126, the wire side 128, and the flange 134. The outer shell 130 of the lamp side 126 is substantially cylindrical and encloses a lamp receptacle 200 that receives the lamp holder 162 of the lamp assembly 120. The lamp receptacle 200 includes first and second open channels 202 and 204, respectively, that are substantially diametrically opposed on opposite sides of the housing 122 within the outer shell 130. In one embodiment, the open channels 202 and 204 are substantially U-shaped and extend above an upper rim 210 of the outer shell 130. The open channels 202 and 204 each receive one of the end panels 164, 166 of the lamp holder 162 when the lamp assembly 120 is inserted into the lamp socket 110. Each open channel 202, 204 includes an end wall 216 and a pair of opposed side walls 218. In one embodiment, the outer surfaces of the end walls 216 are coextensive with an outer surface 220 of the outer shell 130.

Terminal contacts 230, 232, and 234 are loaded into contact cavities (not shown) in the wire side 128 of the housing 122. The terminal contact 230 has double blades 236 and 238 and, in one embodiment is a ground contact. The ground contact 230 provides a common ground for all the filament circuits in the lamp assembly 120. The terminal contacts 232 and 234 are separate power contacts that deliver current to the filament circuits within the lamp assembly 120. More specifically, the terminal contacts 230, 232, and 234 support the presence of two filament circuits within the bulb 160, which identifies the bulb 160 as a two-filament bulb.

Figure 4:
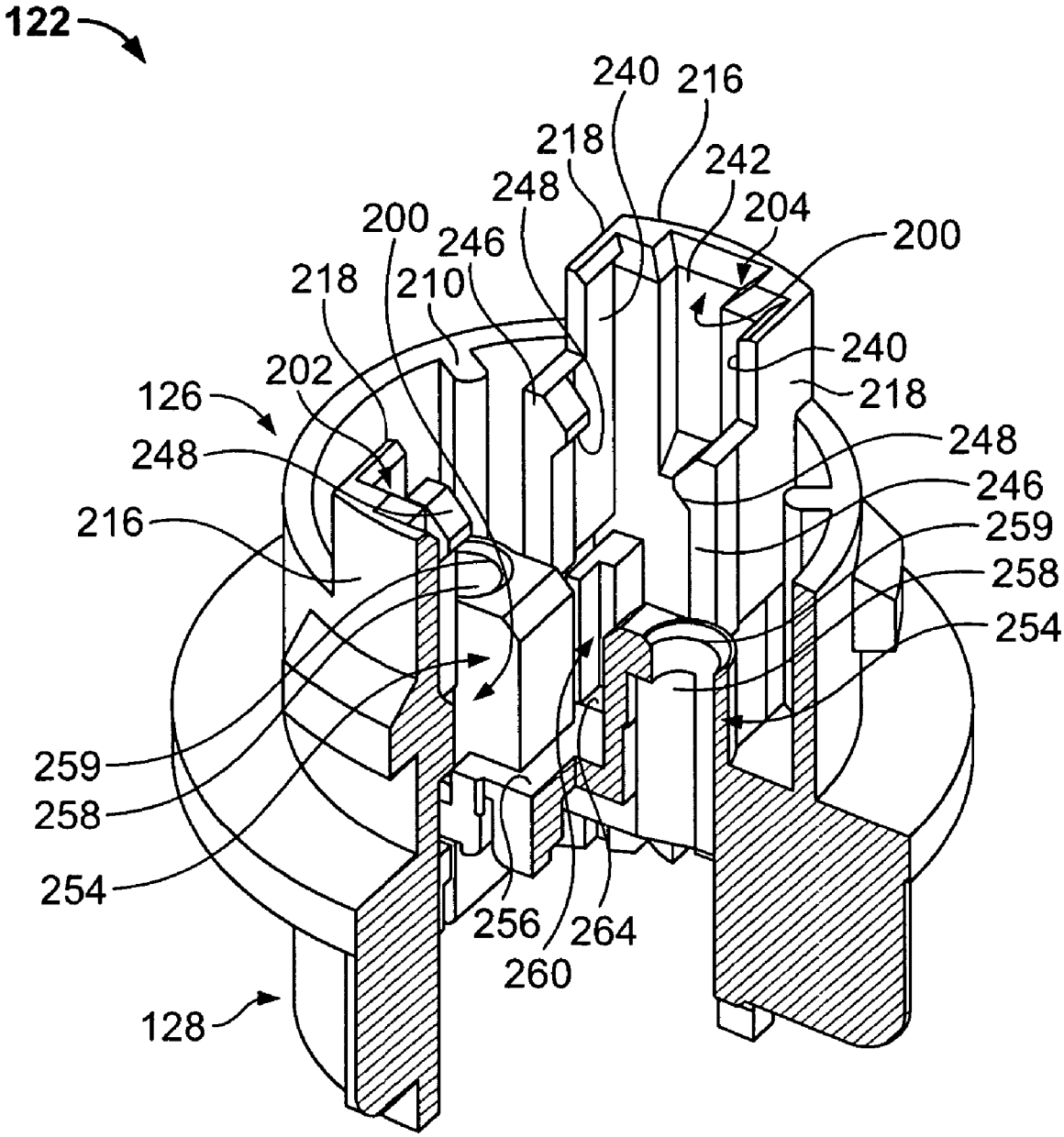
FIG. 4 is a perspective view of the socket housing shown in FIG. 1 with a section of the housing removed.

FIG. 4 is a detail view in perspective of the socket housing 122. The lamp receptacle 200 includes the open channels 202 and 204. The open channels 202 and 204 have end walls 216 between opposed side walls 218. Each of the side walls 218 include an engagement surface that engages the side edges 174 (FIG. 3) of the end panels 164 and 166 (FIG. 3) to retain the lamp assembly 120 (FIG. 3) in the lamp receptacle 200. In one embodiment, an interior surface 240 of the side wall 218 comprises the engagement surface. The side edges 174 of the lamp holder 162 engage the interior surfaces 240 of the side walls 218 with an interference fit to assist in retaining and stabilizing the lamp assembly 120 when the lamp holder 162 is inserted in the lamp receptacle 200. A slot 242 formed in the interior of the end wall 216 receives the tab 176 to locate the lamp holder 162 in the lamp receptacle 200. The tab 176 also engages the slot 242 to facilitate the retention of the lamp holder 162 in the lamp receptacle 200. A latch member 246 is formed on the interior surface 240 of each side wall 218. Each latch member 246 includes a latch element 248 formed thereon that engage the retention ledges 170 to retain the lamp holder 162 in the lamp receptacle 200. In one embodiment, the latch elements 248 snap over the retention ledges 170 as the lamp holder 162 is inserted into the lamp receptacle 200 to engage the retention ledges 170 with a snap fit.

Figure 6:
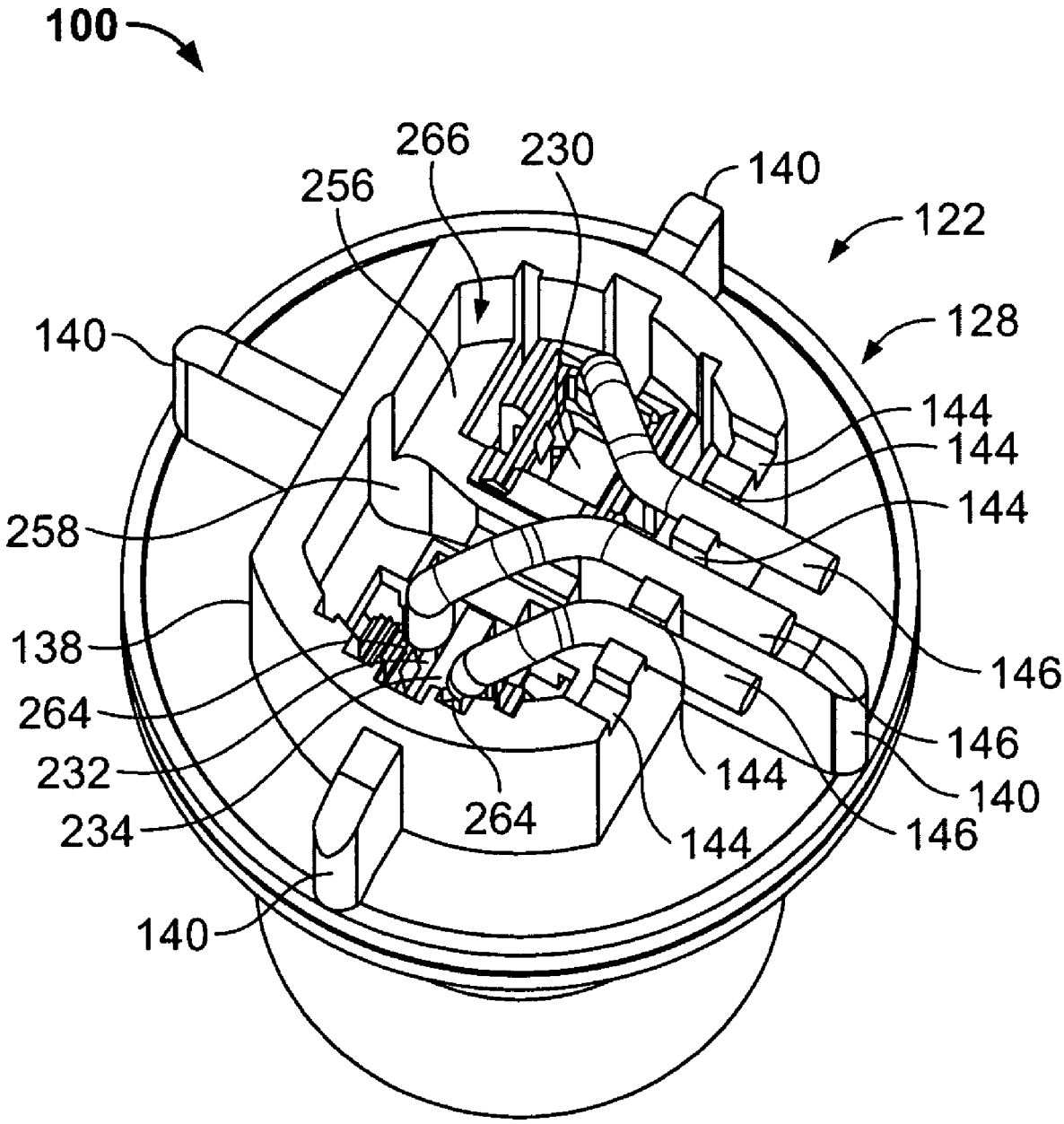
FIG. 6 is a detail view in perspective of the wire side of the lamp and socket assembly shown in FIG. 1.

A pair of stabilizing towers 254 extend upwardly from a floor 256 of the lamp side 126 of the socket housing 122. The floor 256 separates the lamp side of the socket housing 122 from the wire side 128 of the socket housing 122. The stabilizing towers 254 are positioned adjacent the lamp receptacle 200 and at least one stabilizing tower 254 includes a passageway 258 that has a opening 259 that is elevated from the floor 256. In an exemplary embodiment, both stabilizing towers 254 include a passageway 258. The passageways 258 extends from the lamp side 126 to the wire side 128 of the housing 122. The passageways 258 are provided so that a potting compound can be introduced into the wire side 128 of the housing 122 from the lamp side 126 of the housing 122. The potting compound, when introduced into the passageways 258 flows under the influence of gravity to the wire side 128. The stabilizing towers 254 define a gap 260 therebetween that receives the lamp extension 180 when the lamb holder 162 is inserted into the lamp receptacle 200. In an exemplary embodiment, the lamp extension 180 is received in the gap 260 and facilitates the retention of the lamp assembly 120 in the lamp receptacle 200. Terminal contact apertures 264, best shown in FIG. 6, are formed in the floor 256 separating the lamp side 128 and wire side 126 of the socket housing 122 to receive the terminal contacts 230, 232, and 234 (FIG. 3).

Figure 5:
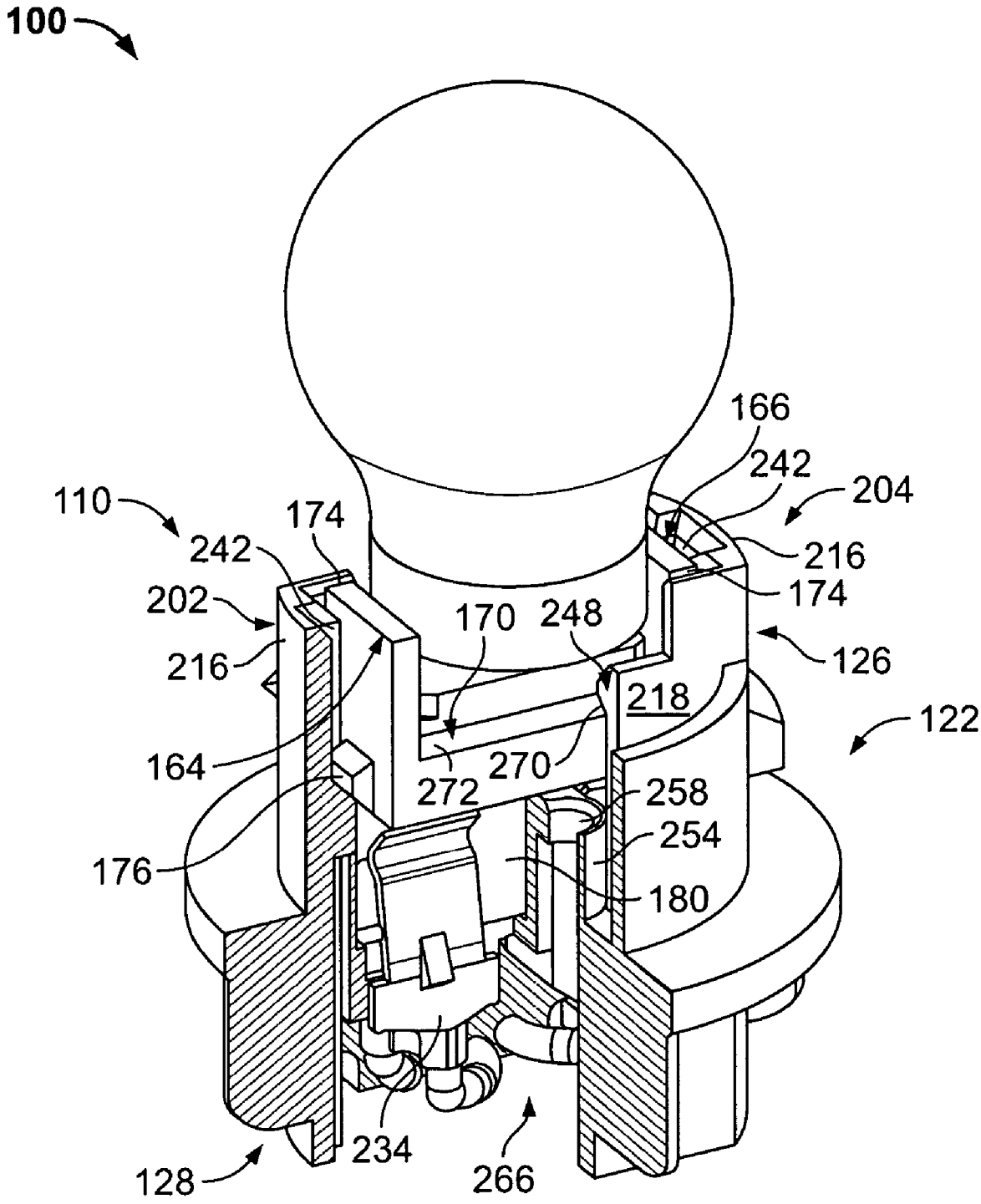
FIG. 5 is a perspective view of the lamp and socket assembly shown in FIG. 1 with a section of the housing removed.

FIG. 5 is a perspective view of the lamp and socket assembly 100 with a portion of the housing 122 cut away. In FIG. 5, the lamp assembly 120 is seated in the lamp receptacle 200 in the lamp side 126 of the socket housing 122.

The wire side 128 of the socket housing 122 includes a wiring cavity 266. The contacts 230, 232, and 234 are inserted from the wiring cavity 266 through the apertures 264 in the floor 256 to electrically engage the contacts 182 (FIG. 3) in the lamp extension 180. The terminal contact 234 is visible through the cut away in FIG. 5, and is shown in engagement with the lamp extension 180 such that an electrical connection is established with one of the electrical contacts 182. The remaining terminal contacts 230, and 232 electrically engage the remaining electrical contacts 182 in the lamp extension 180 in a similar manner.

The side edges 174 of the end panels 164, 166 are shown engaging the interior side walls 240 of the open channels 202 and 204 with an interference fit to assist in retaining the lamp holder 162 in the lamp receptacle 200. Similarly, the tabs 176 are also received in the alignment slots 242 and engage the slots 242 to promote retention of the lamp holder 162 in the lamp receptacle 200. In addition, and more importantly, the tabs 176 are received in the alignment slot 242 so that the lamp extension 180 is oriented to be received between the ends of the contacts 130, 132, 134 so that electrical connections are established with the contacts 182 in the lamp extension 180.

Retention of the of the lamp assembly 120 in the socket housing 122 is further facilitated through the engagement of the latch elements 248 on the inner side walls 240 of the open channels 204 and 204 with the retention ledge 170 on the lamp holder 162. Each latch element 248 is provided with a beveled engagement surface 270. Similarly, the retention ledge 170 is provided with a beveled engagement surface 272. When the engagement surfaces 270 and 272 are engaged with one another, the lamp assembly 120 is retained in the housing 122. The bevels provided on the engagement surfaces 270 and 272 also allow for separation of the lamp assembly 120 from the housing 122, however a separating force is required that is sufficient to deflect the side walls 218 of the open channels 202 and 204 in order to extract the lamp assembly 120 from the socket housing 122.

FIG. 6 is a perspective of the wire side 128 of the housing 122 of the lamp and socket 100. The wire side 128 of the socket housing 122 includes the wiring cavity 266 that is separated from the lamp side 126 by the floor 256. The wire side outer shell 138 from which the tabs 140 extend forms a wall around the wiring cavity 266. The terminal contacts 230, 232, and 234 are loaded in the contact apertures 264 and extend through the floor 256 and into the lamp side 126 of the socket housing 122 as best shown in FIG. 5. The conductors or wires 146 from the terminal contacts 230, 232, and 234 exit the wiring cavity 266 through the wire guide channels 144. The passageways 258, only one of which is visible in FIG. 6, extend through the stabilizing towers 254 from the lamp side 126 and into the wiring cavity 266 on the wire side 128 of the socket housing 122. The passageways 258 provide conduits through which a potting compound can be introduced into the wiring cavity 266 to seal the wiring cavity 266.

It is well known to apply a potting compound in the wiring cavities of socket housings to seal the wiring cavities. Sealing the wiring cavity keeps out moisture that could cause corrosion and associated deterioration of the connections between the electrical contacts and the terminal contacts in the socket. Sealing also provides for the mechanical retention of the wires and some degree of stress protection for the wiring and also of the socket assembly, should someone pull on the wires.

Heretofore, sealing of wiring cavities has been accomplished from the wire side with the socket housing in an inverted position, that is, with the wire side facing upward. In this condition, the potting compound could seep into the lamp side of the housing and compromise the electrical connections in the lamp side. If the wiring cavity could be sealed by introducing potting compound from the lamp side of the socket housing, concern for contamination of the electrical connections on the lamp side of the housing could be alleviated.

Figure 7:
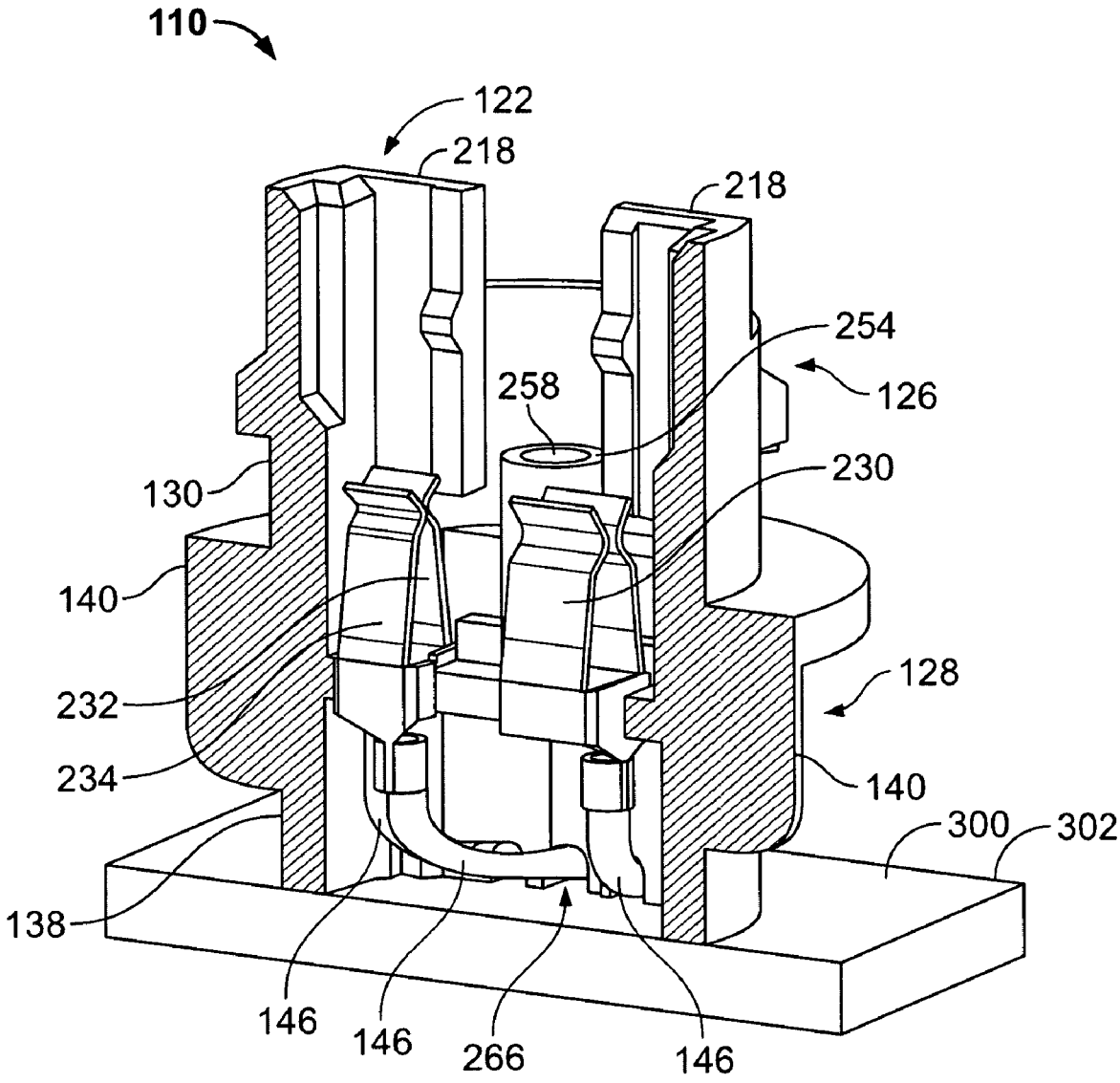
FIG. 7 is a cross sectional view of a socket housing prepared for potting in accordance with an exemplary embodiment of the present invention.

FIG. 7 is a cross sectional view of the socket housing 122 prepared for potting in accordance with an exemplary method for potting the wiring cavity 266 in the housing 122 of the lamp socket 110. The provision of the stabilizing towers 254 and the passageways 258 provides for a potting method that alleviates the concerns and potential problems associated with seepage of potting compound into the lamp side 126 of the socket housing 122.

According to the method, and with reference to FIG. 7, the lamp socket housing 122 is fabricated with a passageway 258 between the wiring cavity 266 and the lamp side 126 of the socket housing 122. Next, the socket housing 122 is positioned on a non-adhering surface 300 with the lamp side 126 facing upward and the wiring cavity 266 facing downward, such that the wiring cavity 266 is blocked by the non adhering surface 300. The potting compound is then introduced into the wiring cavity 266 from the lamp side 126 of the socket housing 122 through the passageway 258. The socket housing 122 is removed from the non-adhering surface 300 after the potting compound has hardened.

More specifically, when introducing the potting compound into the wiring cavity 266, a measured amount of potting compound sufficient to fill the wiring cavity 266 is introduced so that there is no overflow of potting compound into the lamp side 126 of the socket housing 122. And further, the non-adhering surface 300 may comprise an upwardly facing surface 300 of a plate 302 fabricated from a non-adhering material such as TEFLON® which is made and marketed by DuPont.

Figure 8:
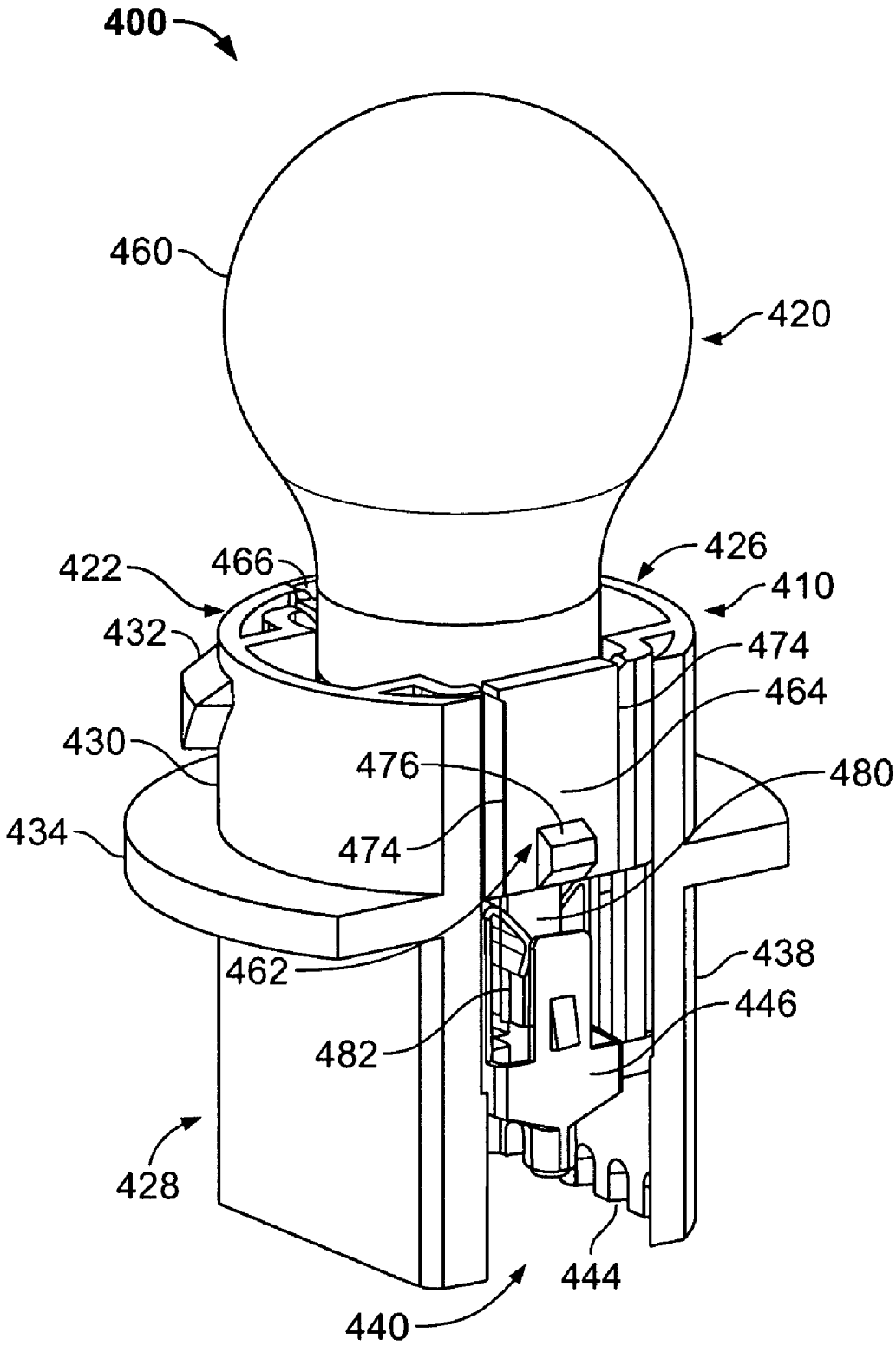
FIG. 8 is a perspective view of a lamp and socket assembly formed in accordance with an alternative embodiment of the present invention.

FIG. 8 is a perspective view of a lamp and socket assembly 400 formed in accordance with an alternative embodiment of the present invention. The lamp and socket assembly 400 includes a lamp socket 410 and a lamp assembly 420 that is mounted in the lamp socket 410. The lamp socket 410 includes a housing 422 that has a lamp side 426 and a wire side 428. The lamp side 426 has an outer shell 430 that has a plurality of lugs 432 formed thereon. A mounting flange 434 separates the lamp side 426 and the wire side 428 of the housing 422. A seal (not shown) may be provided on the mounting flange 434 to seal a mounting hole in a lamp housing such as the lamp housing 150 shown in FIG. 2. The wire side 428 includes an outer shell 438 that encloses a wiring cavity 440. A plurality of wire guide channels 444 are formed in the wire side outer shell 438 to permit the entry of wires (not shown) into the wiring cavity 440 to electrically connect with terminal contacts such as the terminal contact 446 which is a double blade ground contact. The housing 422 also receives single blade contacts such as the terminal contacts 232 and 234 shown in FIG. 3.

The lamp assembly 420 is substantially identical to the lamp assembly 120 previously described and shown in FIG. 3, and like reference numbering will be used to describe like elements. The lamp assembly 420 includes a lamp or bulb 460 that upwardly extends from a lamp holder 462. The lamp holder 462 includes a first end panel 464 and a second end panel 466. The lamp 460 is positioned between the end panels 464 and 466 and rests on a cross member (not shown) between the end panels 464 and 466. The end panels 464 and 466 each include side edges 474 and a tab 476 centrally positioned between the side edges 474. The lamp 460 includes an integrally formed extension 480 that extends downwardly through a slot (not shown) in the cross member. Electrical contacts 482 are positioned on the lamp extension 480. The contacts 482 are electrically connected to one or more filaments (not shown) within the lamp 460.

Figure 9:
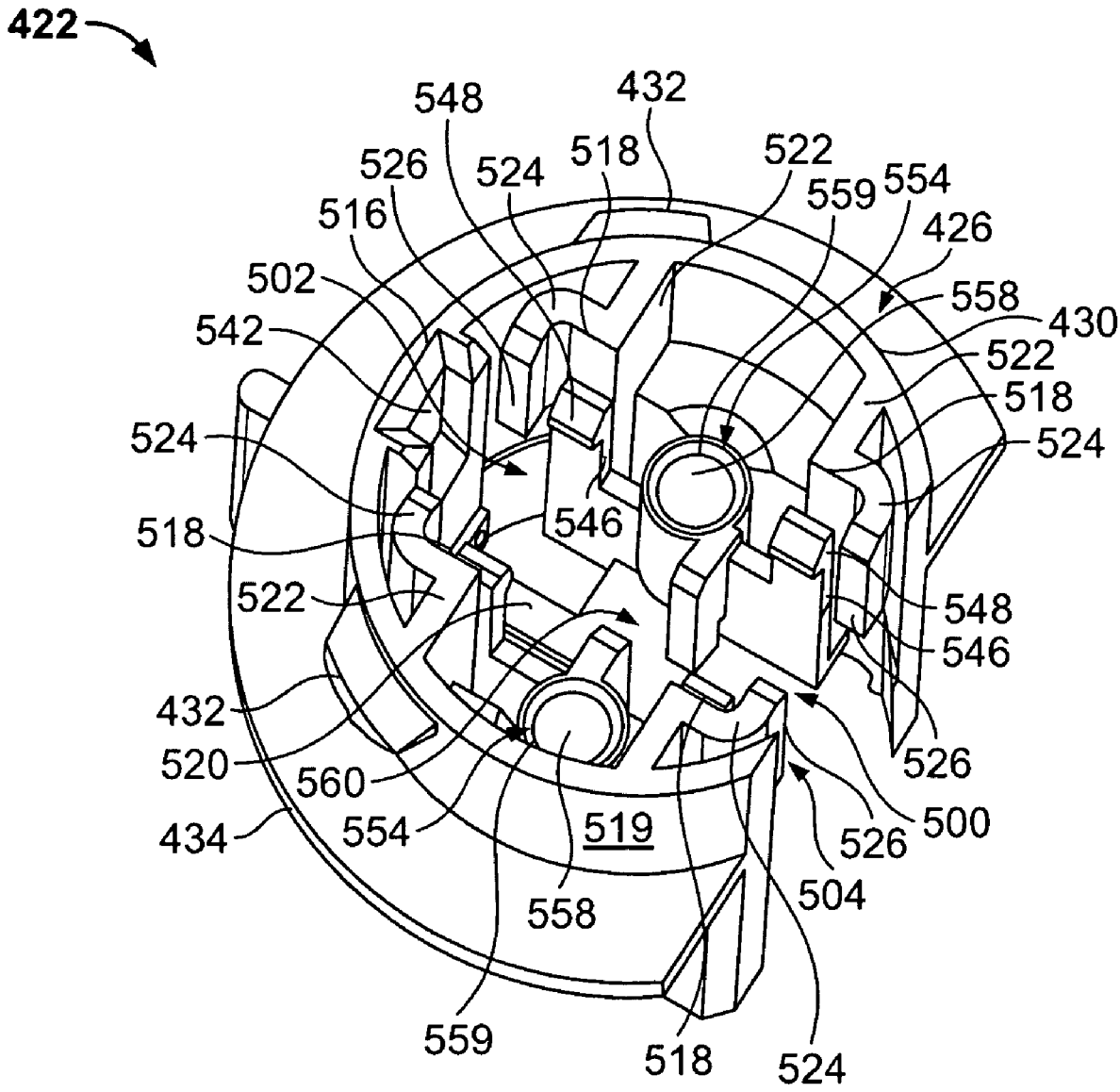
FIG. 9 is a top perspective view of the socket housing shown in FIG. 8.

FIG. 9 is a top perspective view of the socket housing 422 with a section removed. The housing 422 of the lamp socket 410 is fabricated from a dielectric material and in an exemplary embodiment is a unitary structure that comprises the lamp side 426, the wire side 428, and the flange 434. The outer shell 430 of the lamp side 426 is substantially cylindrical and encloses a lamp receptacle 500 that receives the lamp holder 462 of the lamp assembly 420. The lamp receptacle 500 includes first and second open channels 502 and 504, respectively, that are substantially diametrically opposed on opposite sides of the housing 422 within the outer shell 430. The open channels 502 and 504 each receive one of the end panels 464, 466 of the holder 462 when the lamp assembly 420 is inserted into the lamp socket 410. Each open channel 502, 504 includes an end wall 516 and a pair of opposed interior side walls 518 that are formed in the interior of the lamp side 426 proximate the end walls 516. In one embodiment, the outer surfaces of the end walls 516 are coextensive with an outer surface 519 of the outer shell 430. The interior side walls 518 extend upwardly from a floor 520 that separates the lamp side 426 from the wire side 428 of the socket housing 422. In an exemplary embodiment, a reinforcing wall 522 joins each side wall 518 to the outer shell 430. A stabilizing arm 524 extends from each interior side wall 518. Each stabilizing arm 524 includes an engagement surface 526. When the lamp assembly 420 is installed in the housing 422, the engagement surfaces 526 on the stabilizing arms 524 engage the side edges 474 (FIG. 8) of the end panels 464 and 466 of the lamp holder 462 to stabilize the lamp assembly 420 in the housing 422. In one embodiment, the stabilizing arms 524 exhibit a degree of flexibility.

A slot 542 formed in the interior of the end wall 516 receives the tab 476 on the end panels 464 and 466 (FIG. 8) to locate the lamp holder 462 in the lamp receptacle 500. The tab 476 also engages the slot 542 to facilitate the retention of the lamp holder 462 in the lamp receptacle 500. A latch member 546 is formed on each of the interior side walls 518. Each latch member 546 includes a latch element 548 formed thereon that engages retention ledges, such as the retention ledges 170 (FIG. 3), on the lamp holder 462 to retain the lamp holder 462 in the lamp receptacle 500. In one embodiment, the latch elements 548 snap over the retention ledges (not shown) as the lamp holder 462 is inserted into the lamp receptacle 500 to engage the retention ledges with a snap fit. The latch members 546 and latch elements 548 retain the lamp assembly 420 in the socket housing 422 as with the previously described embodiments.

A pair of stabilizing towers 554 extend upwardly from the floor 520 of the lamp side 426 of the housing 422. The floor 520 separates the lamp side 426 of the housing 422 from the wire side 428 (FIG. 8) of the socket housing 422. The stabilizing towers 554 are positioned adjacent the lamp receptacle 500 and at least one stabilizing tower 554 includes a passageway 558 that has a opening 559 that is elevated from the floor 520. In an exemplary embodiment, both stabilizing towers 554 include a passageway 558. The passageway 558 extends from the lamp side 426 to the wire side 428 of the housing 422. The passageways 558 are provided so that a potting compound can be introduced into the wire side 428 of the housing 422 from the lamp side 426 of the housing 422. The potting compound, when introduced into the passageways 558 flows under the influence of gravity to the wire side 428. The stabilizing towers 554 define a gap 560 therebetween that receives the lamp extension 480 (FIG. 8) when the lamp holder 462 is inserted into the lamp receptacle 500. In an exemplary embodiment, the lamp extension 480 is received in the gap 560 and facilitates the retention of the lamp assembly 420 in the lamp receptacle 500. Terminal contact apertures (not shown) are formed in the floor 520 separating the lamp side 428 and wire side 426 of the socket housing 422 to receive the terminal contacts 446 (FIG. 8).

Figure 10:
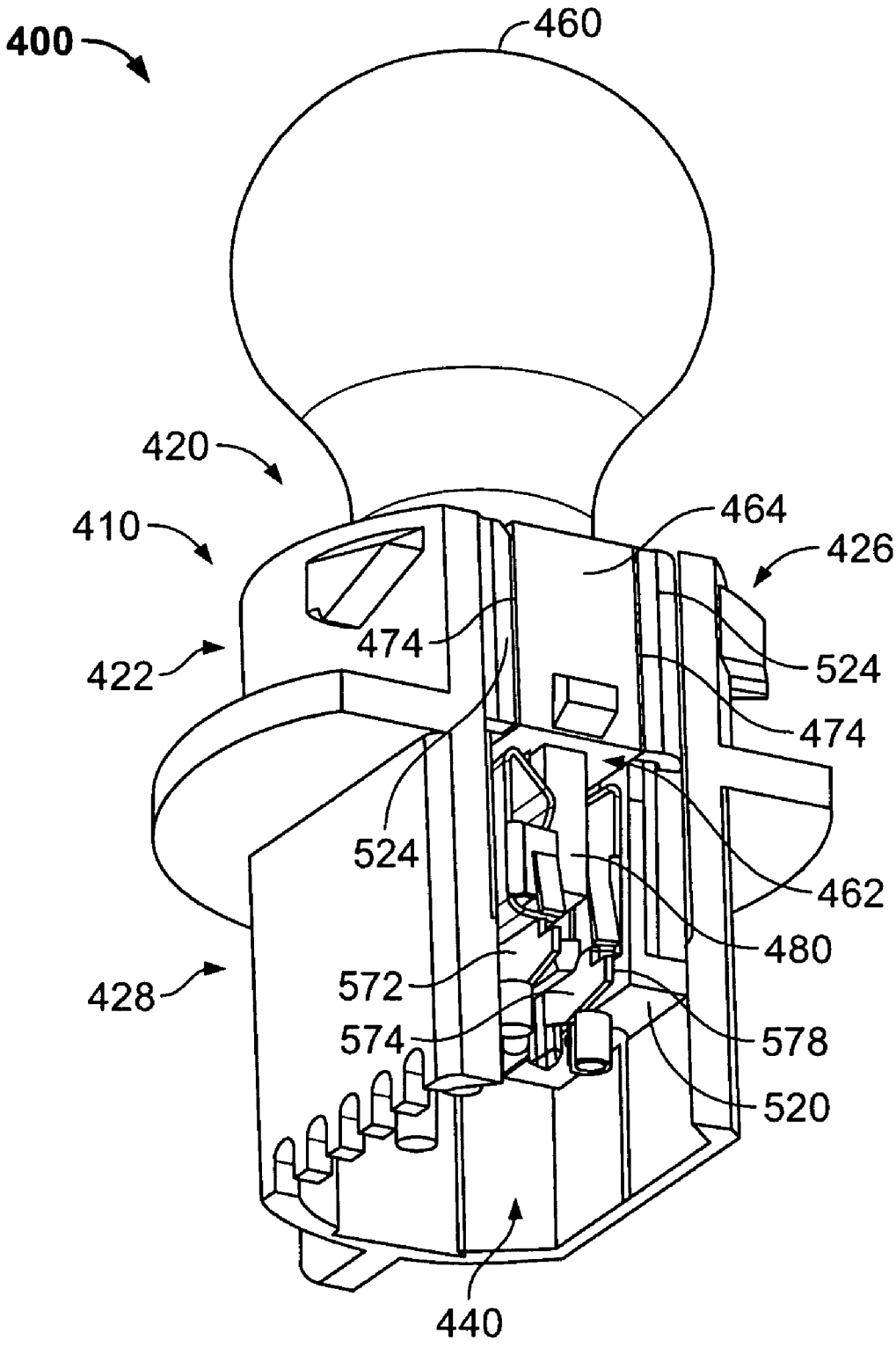
FIG. 10 is a perspective view from the wire side of the lamp and socket assembly shown in FIG. 8.

FIG. 10 is a perspective view of the lamp and socket assembly 400 with a portion of the housing 410 cut away. In FIG. 10, the lamp assembly 420 is seated in the lamp receptacle 500 in the lamp side 426 of the socket housing 422. Single terminal contacts 572 and 574, along with the double contact 446 (FIG. 8) are inserted from the wiring cavity 440 through the apertures 578 in the floor 520 to electrically engage the contacts 482 (FIG. 8) in the lamp extension 480.

The side edges 474 of the end panels 464, are in engagement with the stabilizing arms 524 to stabilize the lamp holder 462 in the lamp receptacle 500 (FIG. 9). Similarly, the tabs 476 are also received in the alignment slots 542 engaging the alignment slots 542 to promote retention of the lamp holder 462 in the lamp receptacle 500. In addition, the tabs 476 are received in the alignment slots 542 so that the lamp extension 480 is oriented to be received between the ends of the contacts 572 and 574 so that electrical connections are established with the contacts 482 (FIG. 8) in the lamp extension 480. The wiring cavity 440 may be sealed with a potting compound according to the sealing method previously described.

The embodiments thus described provide a potted lamp socket that includes retention features to securely retain a lamp assembly. In one embodiment, the lamp socket 110 includes a housing 122, having a lamp receptacle 200, that comprises a pair of open channels 202, 204 opposite each other on a lamp side 126 of the socket housing 122. The lamp receptacle 200 receives a lamp holder 162 of a lamp assembly 120. The sides 218 of the open channels 202, 204 include interior surfaces 240 that engage side edges 174 of the end panels 164, 166 of the lamp holder 162 to assist in retaining the lamp holder 162 in the lamp receptacle. The end panels 164, 166 of the lamp holder 162 also include tabs 176 that are received in and engage slots (242) in the open channels 202, 204 to align the lamp holder 162 in the lamp receptacle 200 and to assist in retaining the lamp holder 162 in the lamp receptacle 200. Alternatively, the open channels 502, 504 include stabilizing arms 524 extending from interior side walls 518 engage the side edges 474 of the end panels 464, 466 to stabilize the lamp assembly 420 in the socket housing 422. A potting method is also provided for sealing a wiring cavity 266. The potting operation is performed with the lamp side 126 facing upward and the wiring cavity 266 facing downward and positioned on a non-adhering surface 300. A pre-measured amount of potting compound is introduced into the wiring cavity 266 from the lamp side 126 through a passageway 258 into the wiring cavity 266. Introducing the potting compound from the lamp side 126 alleviates problems associated with seepage of potting compound into the contact areas in the lamp side 126 of the socket housing 122.

While the invention has been described in terms of various specific embodiments, those skilled in the art will recognize that the invention can be practiced with modification within the spirit and scope of the claims.

What is claimed is:

1. A lamp and socket assembly comprising:

a lamp assembly including a lamp holder having an end panel;

a housing having a lamp side and a wire side, said lamp side including a lamp receptacle, said lamp holder received in said lamp receptacle, wherein said lamp receptacle includes a pair of stabilizing towers, at least one of said stabilizing towers defining a passageway therethrough from said lamp side to said wire side of said housing; and a channel formed in said lamp receptacle, said channel including opposed side walls, each said side wall having an engagement surface, said engagement surfaces engaging side edges of said end panel to retain said lamp assembly in said lamp receptacle.

2. The lamp and socket assembly of claim 1, further comprising a seal mounted on said housing to seal a mounting hole in a lamp housing.

3. The lamp and socket assembly of claim 1, wherein said housing includes an outer shell and each said side wall includes a reinforcing wall joining said side wall with said outer shell.

4. The lamp and socket assembly of claim 1, wherein said lamp holder includes first and second end panels and said channel comprises first and second open channels, each said open channel receiving one of said end panels of said lamp holder.

5. The lamp and socket assembly of claim 1, wherein said lamp assembly includes a lamp extension and said lamp receptacle includes said pair of stabilizing towers, said stabilizing towers defining a gap therebetween, and wherein said lamp extension is received in said gap.

6. The lamp and socket assembly of claim 1, wherein said channel comprises first and second open channels, each said open channel including an end wall and a pair of opposed side walls, and wherein a latch member is formed on at least one of said side walls.

7. The lamp and socket assembly of claim 1, wherein said lamp holder includes first and second end panels, and said channel comprises first and second open channels, each said open channel including an end wall having an alignment slot, and each said end panel includes a positioning tab formed thereon and, wherein said positioning tabs are received in said alignment slots.

8. The lamp and socket assembly of claim 1, wherein said lamp holder includes first and second end panels, and said channel comprises first and second open channels, each said open channel including an end wall and a pair of opposed side walls, and wherein said engagement surfaces comprise interior surfaces of said side walls.

9. The lamp and socket assembly of claim 1, wherein said lamp holder includes first and second end panels, and said channel comprises first and second open channels, each said open channel including an end wall and a pair of opposed side walls, each said side wall having an arm extending therefrom, and wherein said engagement surfaces are located on said arms.

10. The lamp and socket assembly of claim 1, wherein said wire side of said housing includes a wiring cavity that is sealed with a potting material.

11. A lamp socket for holding a lamp mounted in a lamp bolder that includes first and second end panels, said lamp socket comprising:

a housing having a lamp side and a wire side, said lamp side including a lamp receptacle configured to receive the lamp holder, wherein said lamp receptacle includes first and second open channels each including an end wall and a pair of opposed side walls, said side walls engaging opposed side edges of said end panels to stabilize said lamp assembly in said lamp receptacle; and a passageway extending from said lamp side to said wire side, said passageway having a lamp side opening that is elevated from a floor separating said lamp side from said wire side, said passageway configured to convey a potting material from said lamp side to said wire side to seal said wire side.

12. The lamp socket of claim 11, further comprising a seal mounted on said housing to seal a mounting hole in a lamp housing.

13. The lamp socket of claim 11, wherein said lamp holder includes first and second end panels, each said side wall having an arm extending therefrom, and wherein each said end panel includes side edges that engage said arms to stabilize said lamp assembly in said receptacle.

14. The lamp socket of claim 11, wherein said passageway extends through a stabilizing tower positioned adjacent said lamp receptacle.

15. The lamp socket of claim 11, wherein a latch member is formed on at least one of said side walls.

16. A method for sealing the wiring cavity in a lamp socket housing, wherein the socket housing includes a wire side and a lamp side with the wiring cavity located in the wire side, said method comprising:

fabricating the lamp socket with a passageway between the wiring cavity and the lamp side of the socket housing;

positioning the socket housing on a non-adhering surface the lamp side facing upward and the wiring cavity facing downward such that the wiring cavity is blocked by the non-adhering surface;

introducing a potting compound into the wiring cavity from the lamp side of the socket housing through the passageway; and removing the socket housing from the non-adhering surface after the potting compound has hardened.

17. The method of claim 16 wherein introducing a potting compound into the wiring cavity comprises introducing a measured amount of potting compound into the wiring cavity to prevent an overflow into the lamp side of the socket housing.

18. The method of claim 16 wherein positioning the socket housing on a non-adhering surface comprises positioning the socket housing on an upwardly facing surface of a plate fabricated from a non-adhering material.

* * * * *